US007367853B2

(12) United States Patent
Ainceri et al.

(10) Patent No.: US 7,367,853 B2
(45) Date of Patent: May 6, 2008

(54) CABLE CONNECTOR

(75) Inventors: Rachid Ainceri, Darmstadt (DE); Harald Michael Lutsch, Langen (DE)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 11/766,349

(22) Filed: Jun. 21, 2007

(65) Prior Publication Data

US 2008/0003851 A1 Jan. 3, 2008

(30) Foreign Application Priority Data

Jun. 21, 2006 (DE) ..... 10 2006 028 880

(51) Int. Cl.
*H01R 4/10* (2006.01)

(52) U.S. Cl. ..... 439/877; 439/275; 174/74 R; 174/92

(58) Field of Classification Search ..... 174/72 A, 174/71 R, 74 R, 76, 84 R, 88 R, 92; 439/367, 439/457, 521, 731, 271–275, 877
See application file for complete search history.

(56) References Cited

U.S. PATENT DOCUMENTS

| | | | | |
|---|---|---|---|---|
| RE25,847 | E | 8/1965 | Forney, Jr. | |
| 5,021,611 | A | 6/1991 | Amano | |
| 5,875,547 | A | 3/1999 | Larsson et al. | |
| 6,125,534 | A * | 10/2000 | Varreng | 29/869 |
| 2004/0106316 | A1 | 6/2004 | Noguchi et al. | |

FOREIGN PATENT DOCUMENTS

| | | | |
|---|---|---|---|
| CH | 418 426 | | 2/1967 |
| DE | 41 15 020 | A1 | 11/1992 |
| DE | 4115020 | C3 | 11/1992 |
| DE | 42 37 900 | A1 | 5/1993 |
| DE | 4237900 | B4 | 5/2005 |
| DE | 102004034038 | A1 | 2/2006 |
| EP | 138700 | B | 9/1987 |
| GB | 885233 | | 12/1961 |

* cited by examiner

*Primary Examiner*—Khiem Nguyen
(74) *Attorney, Agent, or Firm*—Sughrue Mion, PLLC

(57) ABSTRACT

A cable connector for electrically conductingly connecting a plurality of separate cables which each are provided with an insulation and an electrical conductor, comprising a connecting sleeve which forms a longitudinal axis), which is continuously open along the longitudinal axis which, along the longitudinal axis, comprises, at a distance from one another, a first open receiving portion and a second open receiving portion, which comprises a connecting portion which is arranged between the two receiving portions, wherein the first receiving portion of the connecting sleeve serves for receiving at least one first cable which is received therein with a first seal being connected therebetween, wherein a bared first conductor portion of the at least one first cable projects into the connecting portion, wherein the second receiving portion of the connecting sleeve serves to receive at least one second cable which is received therein with a second seal being connected therebetween, wherein a bared second conductor portion of the at lest one second cable projects into the connecting portion overlapping with the at least one first conductor portion of the at least one first cable by means of an overlapping portion, wherein the connecting portion, in a plastically deformed way, presses together the bared conductor portions of all cables.

11 Claims, 4 Drawing Sheets

CABLE CONNECTOR

BACKGROUND OF THE INVENTION

The invention relates to a cable connector for electrically conductingly connecting a plurality of separate cables which each comprise an insulation and electrical conductors.

DE 41 15 020 C3 describes a connecting sleeve which is made of an electrically conducting material and which comprises a front cylindrical portion which serves to receive the conductors of two cables which are connected to one another by squeezing the sleeve, so that both cables together, via the connecting sleeve, can be connected to a terminal of a device or a similar piece of equipment. The front cylindrical sleeve portion which receives the insulated part of the cable is joined by a conical portion which is moulded in such a way that there is formed a plastic collar which changes into a receiving portion whose cross-section is adapted to that of two cables, i.e. including the insulation and receives same. The plastic collar which is connected to the conical part of the connecting sleeve comprises an approximately oval shape, and the same applies to the sleeve part adjoining same.

It is the object of the invention to provide a sealed cable connector wherein at least two cables can be connected one behind the other in such a way that there is obtained a directly electrically conducting contact between the conductors of said cables. More particularly, it should be possible to connect a plurality of first cables arranged in parallel relative to one another to at least one further cable in the sense of either a power cable or a collection of same.

In accordance with the invention, the objective is achieved by providing a cable connector for electrically conductingly connecting a plurality of separate cables which each are provided with an insulation and an electrical conductor, comprising a connecting sleeve which forms a longitudinal axis, which is continuously open along the longitudinal axis which, along the longitudinal axis, comprises, at a distance from one another, a first open receiving portion and a second open receiving portion, which comprises a connecting portion which is arranged between the two receiving portions;

wherein the first receiving portion of the connecting sleeve serves for receiving at least one first cable which is received therein with a first seal being connected therebetween, wherein a bared first conductor portion of the at least one first cable projects into the connecting portion, wherein the second receiving portion of the connecting sleeve serves to receive at least one second cable which is received therein with a second seal being connected therebetween, wherein a bared second conductor portion of the at lest one second cable projects into the connecting portion overlapping with the at least one first conductor portion of the at least one first cable by means of an overlapping portion, wherein the connecting portion, in a plastically deformed way, presses together the bared conductor portions of all cables.

SUMMARY OF THE INVENTION

The advantage of this assembly is that it is possible to provide a cable connector wherein the conductors of a plurality of cables can be arranged so as to branch out or they can be combined, wherein, in a simple way, there is produced, simply by squeezing, a connection which achieves a direct conducting contact between the conductors of the cables to be connected. In addition, it is ensured that the connection is liquid- and humidity-proof, which, for example, allows the connection to be used in a motor vehicle in an environment subjected to environmental influences. There is a further advantage in that the connection produced for example by directly squeezing the conductors together constitutes a form-fitting or friction locking connection, so that the electric transition resistance between the cables to be connected is low and, as a result of the dense arrangement, is not adversely affected by the environment.

According to one embodiment of the invention, it is proposed that at least one of the two receiving portions of the connecting sleeve serves to receive at least two cables in a parallel arrangement and that the associated seal comprises a corresponding number of bores for guiding through the cable. The number of receiving portions is adapted to the number of cables to be introduced. Preferably, if two cables, together, enter a receiving portion, it is possible to select an approximately oval or flat cross-section whose side ends are rounded. If, for example, three or more such cables have to be introduced into a receiving portion, the latter can be provided in the form of a polygon with rounded corners.

If only one cable enters one of the two receiving portions, the receiving portion can be circular-cylindrical in shape. In all cases, the seal has to be adapted accordingly and has to be provided with the corresponding number of through-bores. According to an advantageous embodiment, it is proposed that between the first receiving portion and the connecting portion, there is provided a necked portion whose cross-section is reduced relative to those of the above-mentioned portions.

If is advantageous if the connecting sleeve consists of an electrically conducting material and, more particularly, consists of a copper material, so that the connecting sleeve is additionally used in the connecting portion for transmitting the electric power between the conductors of the cables. Furthermore, the connecting sleeve, as a whole, can be covered by an insulating material.

In order to achieve a good transition between the connecting portion receiving the conductor portions only and the receiving portion receiving all the cables and the seal, it is proposed that between the second receiving portion and the connecting portion there is arranged a transition portion which forms a transition from the connecting portion with the greater cross-section to the connecting portion with the reduced cross-section.

Furthermore, a necked portion can be provided between the first receiving portion and the connecting portion, with the cross-section of said necked portion being reduced relative to those of the above-mentioned portions, more particularly if the first receiving portion receives only one cable. The necked portion is then designed in such a way that, practically, only the conductor portion of the only one cable can pass through.

In a preferred embodiment, the electrically conducting connection between the first and the second conductor portion is achieved in that the cross-section of the connecting portion is reduced in such a way that there is produced a friction-locking and/or form-fitting connection of the conductor portions relative to one another and relative to the connecting sleeve respectively. The cross-sectional reduction can be effected by crimping, but also by rotation forming, thus achieving a continuously uniform deformation around the entire cross-section of the connecting portion.

Deformation can also be achieved by producing a groove-like indentation in the outer face of the connecting portion, which indentation then continues into the conductor portions where there exists contact, so that there is achieved an almost form-fitting connection, as a result of which the resistance against the cable being pulled out of the connecting sleeve is increased.

To ensure that the cables are positioned satisfactorily, it is proposed that the first seal and/or the second seal comprise/comprises a collar which is supported against one end of the connecting sleeve.

In order to prevent the first or the second seal from automatically escaping from the connecting sleeve, it is proposed that each bore of the first seal and/or of the second seal, through which there passes a cable, is shaped so as to be stepped, with there existing a step face which is intended to rest against an end face of the cable insulation, which end face points towards the bared conductor portion.

The sealing effect between the insulation and the seal is advantageously affected in that it is proposed that the bore of the first seal and/or of the second seal comprise/comprises a first bore portion by means of which it rests on the insulation, a second bore portion which is provided with at least one annular inner bead, and a third bore portion with a reduced diameter.

The seal between the inner face of the connecting sleeve in the region of the receiving portions and the seal is effected more particularly in that the first seal and/or the second seal are/is provided with at least one continuous outer bead which has a sealing function relative to an inner face of the first receiving portion or second receiving portion receiving same.

BRIEF DESCRIPTION OF THE DRAWINGS

A preferred embodiment of the invention is diagrammatically illustrated in the drawing wherein.

DETAILED DESCRIPTION OF THE INVENTION

Figure 1:
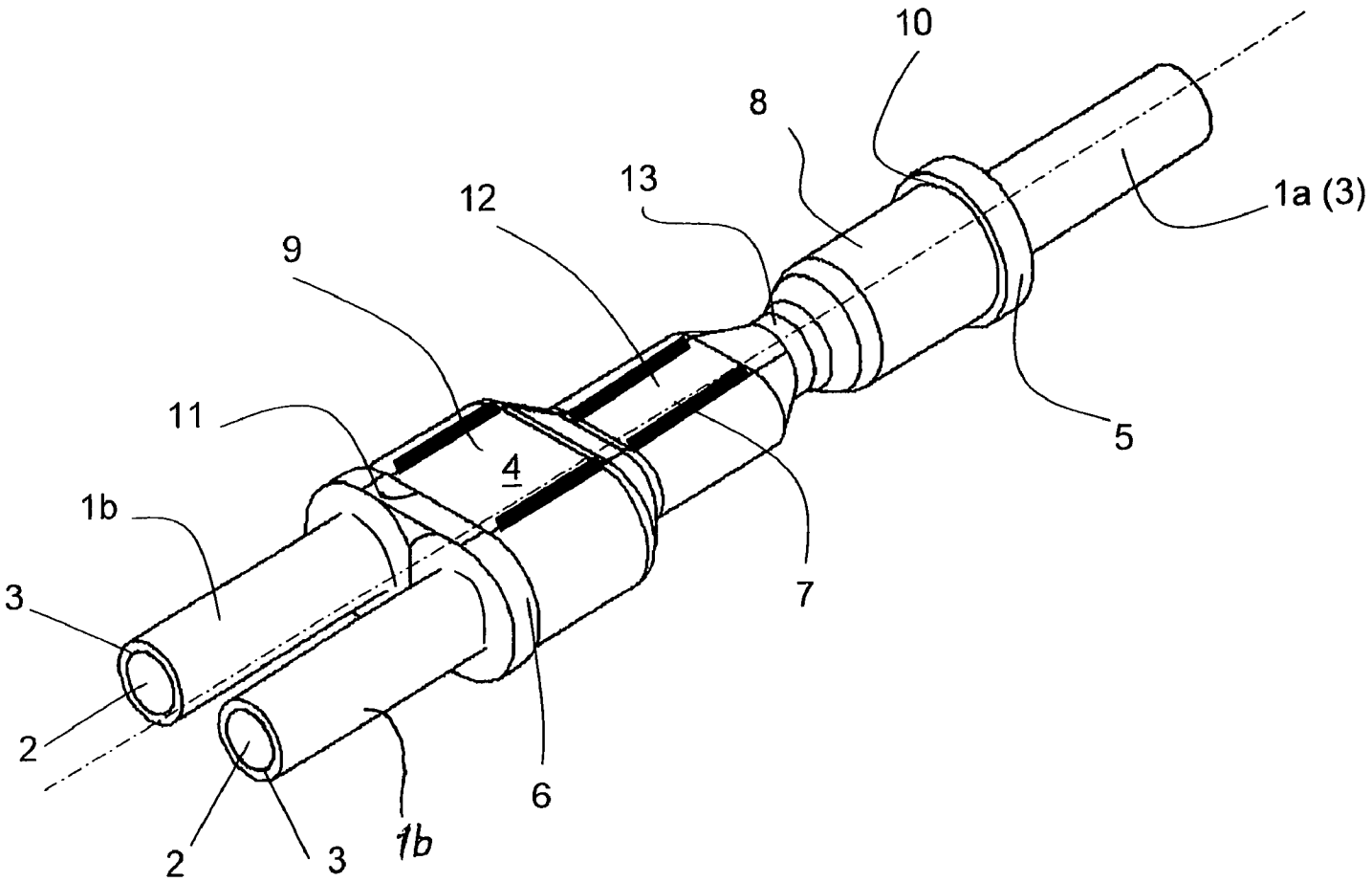
FIG. 1 is a perspective illustration of an assembled cable connector wherein the conductor of a first cable is connected to the conductors of two second cables.
Figure 2:
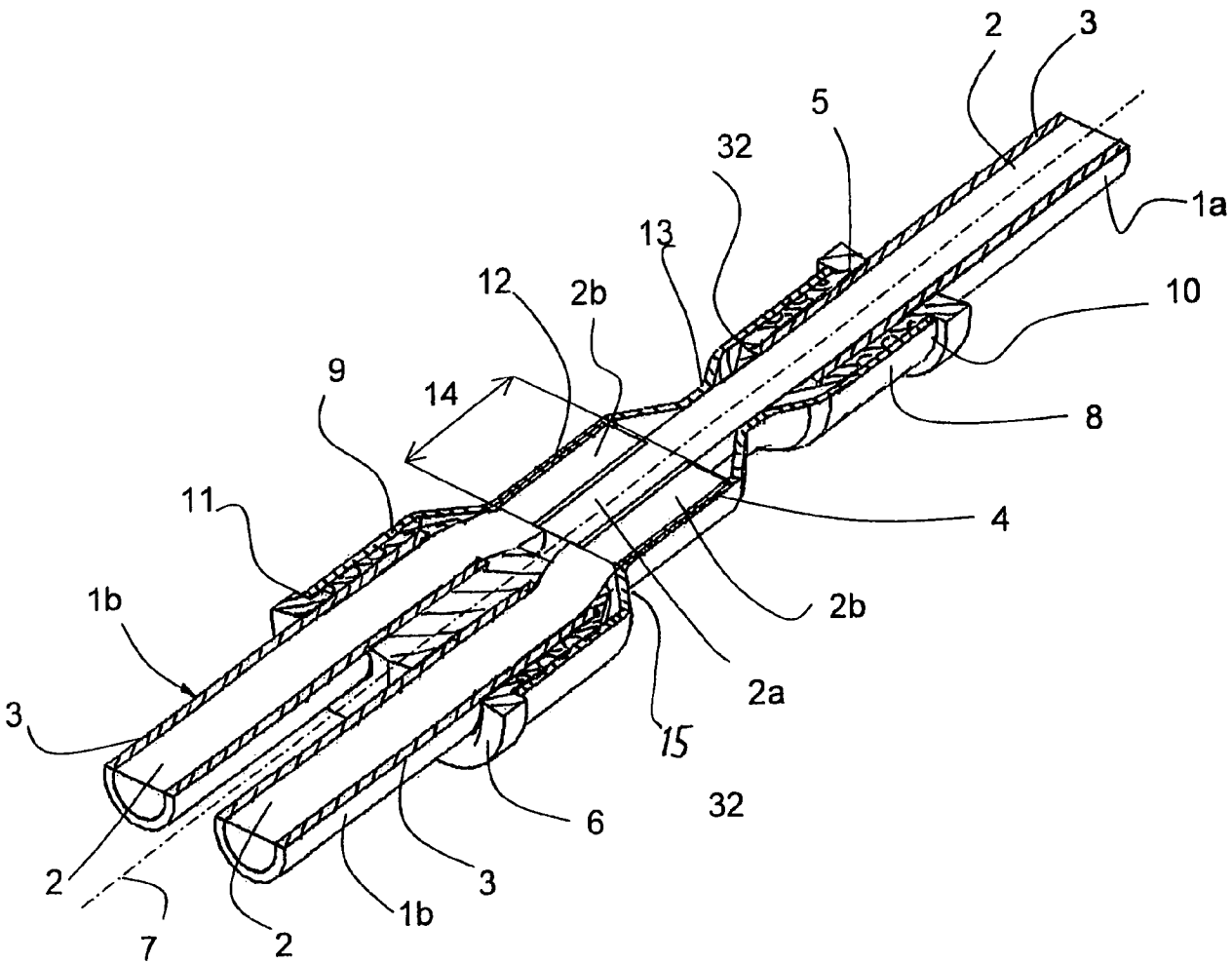
FIG. 2 is a longitudinal section through the cable connector according to FIG. 1.

FIGS. 1 and 2 will be described jointly below. They show a cable connector wherein the conductor portion of a first cable 1*a* is electrically connected to the conductor portions of two second cables 1*b* via a connecting sleeve 4.

In the case of the first cable, the conductor is not visible; only the insulation 3 of the first cable 1*a* can be seen. In the case of the two second cables 1*b*, it is also possible to see the conductor 2 next to the insulation 3. Furthermore, it is possible to identify the connecting sleeve 4 composed of portions, and the two seals 5, 6. All the components and portions are aligned on, and, respectively, parallel to, the longitudinal axis 7.

Below, there will follow a more detailed explanation of the design of the connecting sleeve 4. The connecting sleeve 4 comprises a first receiving portion 8 which, substantially, is provided in the form of a circular-cylindrical hollow cylindrical portion because, in the present embodiment, it is provided only for receiving a round first cable 1*a* with a first seal 5 being arranged therebetween. The whole of the connecting sleeve 4 is hollow and open at its ends 10, 11. It preferably consists of an electrically conducting material, for example of a copper material. Away from the first end 10, the first receiving portion 8 is followed by the connecting portion 12, with a necked portion 13 being arranged therebetween which is designed in such a way that—as can be seen in FIG. 2—the bared conductor portion 2*a* of the first cable 1*a* can pass through the reduced cross-section, which is open in the necked portion 13, into the connecting portion 12 and reach therein.

Away from the first end 10, the connecting portion 12, by means of a transition portion 14, is followed by the second receiving portion 9 which ends at the second end 11. The second receiving portion 9 serves to introduce two second cables 1*b* which each also comprise a conductor 2 which is exposed in the second conductor portion 2*b*. The two exposed conductor portions 2*b* enter the connecting portion 12 in such a way that the conductor portions 2*b* with the conductor portion 2*a* axially overlap by the overlapping portion 14 along the longitudinal axis 7. In a preferred embodiment, the connecting portion 12, in respect of its exit cross-section, can be designed in such a way that, with a specified number of three conductor portions 2*a* and 2*b*, which it has to accommodate, it comprises a more or less oval or oblong laterally rounded profile, so that the three conductor portions 2*a*, 2*b* are received in a way in which they are positioned side by side. The conductor portion 2*a* of the first cable 1*a* is preferably arranged between the two conductor portions 2*b*. The lateral rounded shape can be seen in FIG. 1 for example.

The second receiving portion 9 is designed similarly in respect of its cross-section, with the second seal 6 being arranged between the two second cables 1*b* and the inner face 17 of the second receiving portion 9 of the connecting sleeve 4. As far as the first cable 1*a* and the two second cables 1*b* are concerned, it can be seen that there is an end face 32 in the transition between the exposed conductor portions 2*a*, 2*b* and the insulation 3.

The design of the connecting sleeve 4 such as it was described above can again clearly be seen in FIG. 3. It is possible to identify the different portions, i.e. the first receiving portion 8 starting from the end 10 and having the associated first inner face 16, the second connecting portion 9 ending at the second end 11 and having the inner face 17, as well as the connecting portion 12 which is arranged between said inner face 16 and inner face 17 and which comprises the transitions between the connecting portion 12 and the first receiving portion 8 and the second receiving portion 9 respectively. There are illustrated the necked portion 13 between the first receiving portion 8 and the connecting portion 12 as well as the transition portion 15 between the second receiving portion 9 and the connecting portion 12. It can also be seen that the first receiving portion 8 is provided in the form of a hollow circular cylinder and that the connecting portion 12 and the second receiving portion 9 are similar in respect of shape, with the cross-section of the connecting portion 12 being smaller than the cross-section of the receiving portion 9. The connecting sleeve 4 is preferably produced so as to start from a tube. In the present embodiment, the first receiving portion 8 accommodates a first cable and the second receiving portion 9 accommodates two second cables; there are thus three conductor portions which are received in the region of the connecting portion 12 and are connected to one another by being pressed together, i.e. by reducing the cross-section of the connecting portion 12, as can be seen in FIG. 2. The purpose of the theoretical overlapping of the surfaces covered by the conductor portions 2*a*, 2*b* transversely to the longitudinal axis 7 is to show the extent to which cross-sectional reductions took place.

However, it is also possible to provide embodiments wherein, for example, the first receiving portion 8 serves to receive two cables. Depending on the number of cables to be introduced into the receiving portions 8, 9 and to be electrically connected to one another in the region of the connecting portion 12, said cables have to be adapted to one another in respect of shape.

To be able to maintain conductivity permanently, even if the cable connector is used in humid surroundings such as an engine compartment of a motor vehicle, there are additionally provided the two seals 5, 6 which are associated with the receiving portions 8 and 9 respectively. The shape of the second seal 6 can be seen in FIG. 4 which will be described below. The only difference between the seal shown in FIG. 4 and the seal 5 used in connection with the first receiving portion 8 consists in that the former does not contain a bore for guiding through a cable, because only one cable is guided through the first receiving portion 8 and there is thus needed only one first seal 5 which, accordingly is provided with only one bore through which the only first cable 1*a* passes.

Figure 4:
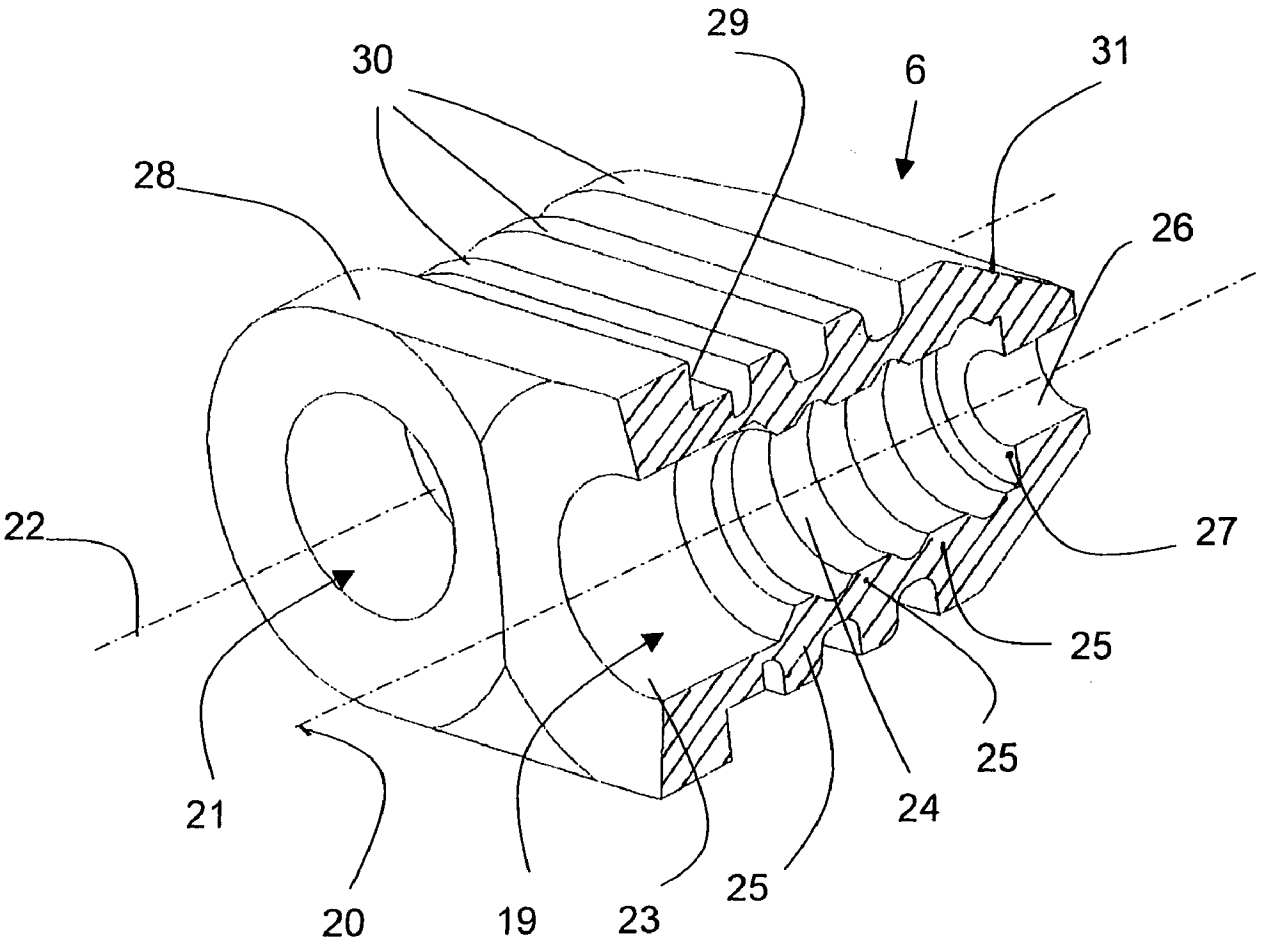
FIG. 4 shows a seal for the second receiving portion with bores to allow the passage of two cables in a perspective illustration, but in the form of a section in the region of a bore along the bore axis.

FIG. 4 shows the second seal 6 in the region of a first bore 19 along the first bore axis 20 in a sectional view.

Next to the first bore 19, there is provided in the second seal a second bore 21 whose second bore axis 22 extends parallel to the first bore axis 20, so that the two second cables as illustrated in FIG. 2 can be introduced in parallel into one each of the two bores 19, 21. As the inner shape of the second bore 21 corresponds to that of the first bore 19, the design is explained only with reference to the first bore 19 which is illustrated in the longitudinal section along the first bore axis 20. It can be seen that the first bore 19 comprises a plurality of bore portions, i.e. the first cylindrical bore portion 23, which substantially, is adapted to the outer diameter of the insulation of the cable to be accommodated. Said first bore portion 23 is followed by a second bore portion 24 which is profiled and has a free cross-section which is smaller than that of the first bore portion 23. Said second bore portion 24, along the first bore axis 20, is provided with a plurality of inner beads 25 which extend around the first bore axis 20 and which are separated from one another by annular indentations. The purpose of said inner beads 25 is to rest, under pretension, against the outside of the insulation of the cable received to achieve a hermetic sealing effect. Said second bore portion 24 ends with a step face 27 with a reduced cross-section and continues along the first bore axis 20 with the third bore portion 26 whose cross-section is substantially adapted to that of the conductor of the cable to be accommodated. The step face 27 serves as a stop for the end face 32 of the insulation 3 in the transition to one of the conductor portions 2*a* and 2*b* respectively of the associated cable. The bared conductor portion 2*a*, 2*b* which is associated with the cable and which enters the connecting portion 12 according to FIG. 2, leaves through the third bore portion 26. The step face 27 serves to secure the second seal 6, so that it cannot, as a result of vibrations or similar impacts, automatically escape the receiving portion 4 in which it is accommodated.

Figure 3:
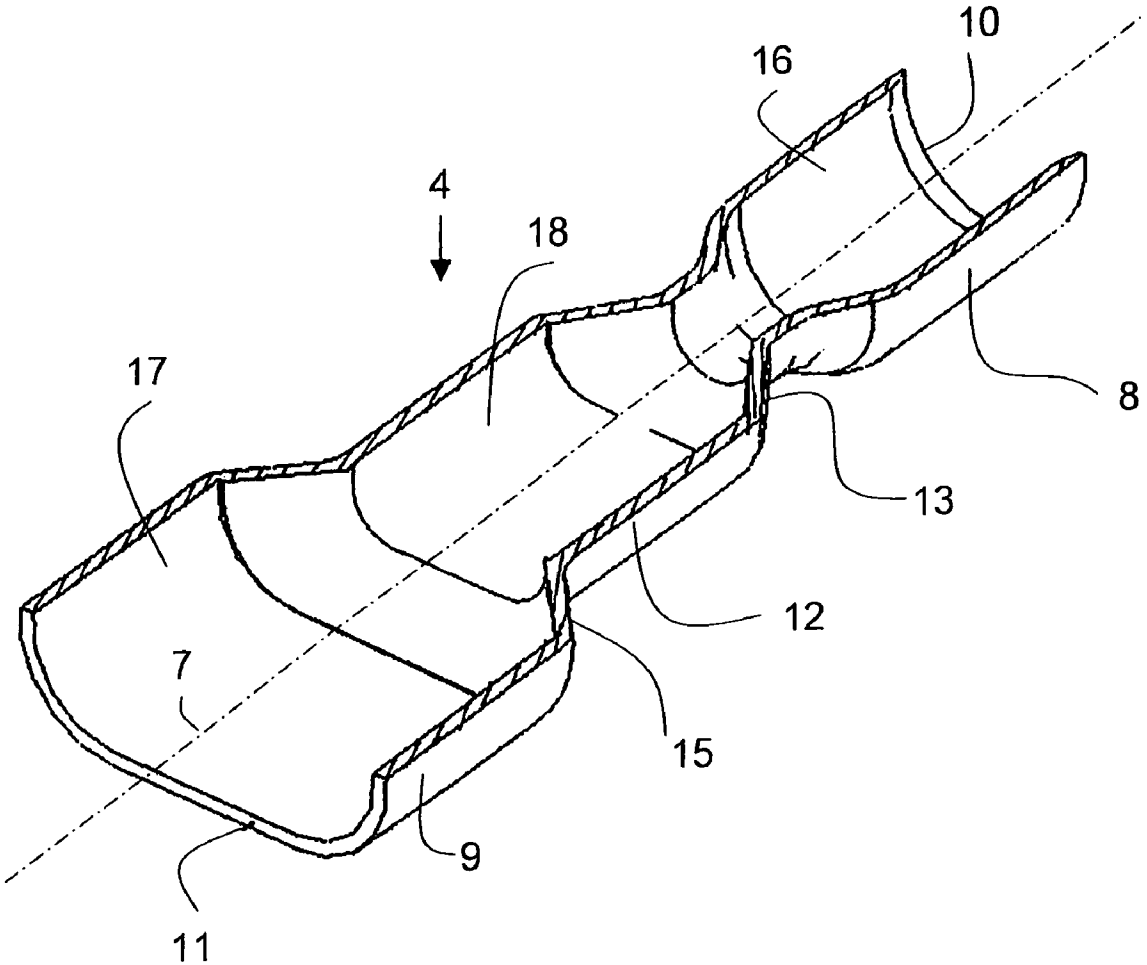
FIG. 3 is a longitudinal section through the connecting sleeve in a perspective illustration in the form of a detail.

On its outside, the second seal 6 is provided with a continuous collar 28 which starts from the end where the cable enters, i.e. in the region of the first bore portion 13, and which comprises a stop face 29 which rests against the associated end face, i.e. in the present case against the end face 11 according to FIGS. 2 and 3 and thus delimits the depth of introduction of the second seal 2, together with the cables accommodated therein, into the second receiving portion according to FIG. 2.

Away from the collar 28, the second seal 6, on its outer circumference, i.e. extending transversely to the two bore axes 20, 22, is provided with outer beads 30 which serve to have a sealing effect relative to the inner face of the second receiving portion 9, i.e. to the inner face 17 illustrated in FIG. 3. Said outer beads 30 are pressed against the inner face 17, so that the seal overall consisting of an elastic material which is suitable for sealing purposes (e.g. elastomer), with the required pretension, seals the associated sealing faces of the connecting sleeve 4 and of the associated cable respectively.

The first seal 5 differs from the second seal only in that it comprises only one bore for receiving one single cable. The number of bores and the shape of the seal have to be selected on the basis of the number of cables to be accommodated, i.e. they have to be adapted to the respective receiving portion of the connecting sleeve 4.

First the cables 1*a*, 1*b* are unisulated (the insolation is removed), so that they constitute insulated conductor portions. Then the first seal 5 is fitted on the first cable 1*a* in such a way that the step face comes to rest against end face of the insulation 3 of the first cable 1*a* leading to the bared first conductor portion 2*a*. The first seal 5 is then introduced into the first receiving portion 8 together with the first cable 1*a*. In the same way, the two second cables 1*b*, after the second conductor portions 2*b* have been exposed, are associated with the second seal 6 and, together, these are slid into the second receiving portion 9. The length of the conductor portions is measured in such a way that there is achieved a predetermined length of overlap 14. Subsequently, pressing takes place in such a way that the cross-section of the connecting portion 12 of the connecting sleeve 4 is reduced and that the conductor portions 2*a*, 2*b* are directly pressed together, with deformation of the conductor portions also being permitted to take place. There is thus produced a direct electrically conducting connection between the cables received in the connecting sleeve 4.

What is claimed is:

1. A cable connector for electrically conductingly connecting a plurality of separate cables which each are provided with an insulation (3) and an electrical conductor, comprising:

a connecting sleeve which forms a longitudinal axis, which is continuously open along the longitudinal axis which, along the longitudinal axis, comprises, at a distance from one another, a first open receiving portion and a second open receiving portion, which comprises a connecting portion which is arranged between the two receiving portions;

wherein the first receiving portion of the connecting sleeve serves for receiving at least one first cable which is received therein with a first seal being connected therebetween, wherein a bared first conductor portion of the at least one first cable (1*a*) projects into the connecting portion, wherein the second receiving portion of the connecting sleeve serves to receive at least one second cable which is received therein with a second seal being connected therebetween, wherein a bared second conductor portion of the at lest one second cable projects into the connecting portion overlapping with the at least one first conductor portion of the at least one first cable (1*a*) by means of an overlapping portion, wherein the connecting portion, in a plastically deformed way, presses together the bared conductor portions of all cables.

2. A cable connector according to claim 1, wherein at least one of the two receiving portions of the connecting sleeve serves to receive at least two cables in a parallel arrangement and that the associated seal comprises a corresponding number of bores for guiding through the cable.

3. A cable connector according to claim 1, wherein there are provided a first cable and two second cables and that, accordingly, the second seal comprises two bores which are arranged in parallel relative to one another.

4. A cable connector according to claim 1, wherein the connecting sleeve includes a copper material.

5. A cable connector according to claim 1, wherein between the second receiving portion and the connecting portion, there is arranged a transition portion which allows a transition from the connecting portion with the greater cross-section to the connecting portion whose cross-section is reduced relative thereto.

6. A cable connector according to claim 1, wherein between the first receiving portion and the connecting portion, there is provided a necked portion whose cross-section is reduced as compared to the cross-sections of the above-mentioned portions.

7. A cable connector according to claim 1, wherein the first and the second conductor portions are connected to one another and to the connecting sleeve in a friction-locking and/or form-fitting way by reducing the cross-section of the connecting portion.

8. A cable connector according to claim 1, wherein the first seal and/or the second seal comprise/comprises a collar which is supported against an end of the connecting sleeve.

9. A cable connector according to claim 1, wherein each bore of the first seal and/or of the second seal through which there passes a cable is stepped, wherein there is provided a step face which is intended to rest against an end face of the insulation of the cable, which end face points towards the bared conductor portion.

10. A cable connector according to claim 1, wherein the bore of the first seal (50) and/or of the second seal comprises a first bore portion by means of which it is positioned on the insulation, a second bore portion which is provided with at least one annular inner bead and with a third bore portion with a reduced diameter.

11. A cable connector according to claim 1, wherein the first seal and/or the second seal are/is provided with at least one continuous outer bead which has a sealing function relative to an inner face of the first receiving portion or of the second receiving portion receiving same.

* * * * *